US008881493B2

(12) United States Patent
Ruegg et al.

(10) Patent No.: US 8,881,493 B2
(45) Date of Patent: Nov. 11, 2014

(54) FORCE APPLICATION ELEMENT, EXTENSION ELEMENT, AND A METHOD FOR INCREASING THE TENSILE LOAD OF A STRIP-SHAPED MATERIAL

(75) Inventors: Christoph Ruegg, Zurich (CH); Reto Clenin, Hagenbuch (CH)

(73) Assignee: Sika Technology AG, Baar (CH)

( * ) Notice: Subject to any disclaimer, the term of this patent is extended or adjusted under 35 U.S.C. 154(b) by 2383 days.

(21) Appl. No.: 10/568,188

(22) PCT Filed: Aug. 13, 2004

(86) PCT No.: PCT/EP2004/051792

§ 371 (c)(1),
(2), (4) Date: Oct. 10, 2008

(87) PCT Pub. No.: WO2005/021894

PCT Pub. Date: Mar. 10, 2005

(65) Prior Publication Data

US 2009/0031667 A1 Feb. 5, 2009

(30) Foreign Application Priority Data

Aug. 13, 2003 (EP) ..... 03018364

(51) Int. Cl.
*E04C 5/08* (2006.01)
*E04C 5/12* (2006.01)
*E04G 23/02* (2006.01)

(52) U.S. Cl.
CPC ..... *E04G 23/0218* (2013.01)
USPC ..... 52/745.21; 52/223.13; 52/223.14

(58) Field of Classification Search
USPC ..... 52/222, 223.1, 223.13, 223.14, 745.21; 29/446, 525.01
See application file for complete search history.

(56) References Cited

U.S. PATENT DOCUMENTS

| | | | | | |
|---|---|---|---|---|---|
| 2,737,802 | A * | 3/1956 | Bakker | 52/223.13 |
| 3,696,573 | A * | 10/1972 | Zerna et al. | 52/223.2 |
| 4,114,242 | A * | 9/1978 | Luthi | 24/115 R |
| 4,744,691 | A * | 5/1988 | Thal | 403/374.2 |
| 5,479,748 | A * | 1/1996 | Siller | 52/231 |
| 6,385,940 | B1 * | 5/2002 | Maier et al. | 52/223.1 |
| 6,389,775 | B1 * | 5/2002 | Steiner et al. | 52/600 |
| 6,584,738 | B1 * | 7/2003 | Andra et al. | 52/223.14 |
| 6,851,232 | B1 * | 2/2005 | Schwegler | 52/223.8 |
| 7,441,380 | B2 * | 10/2008 | Andra et al. | 52/223.13 |
| 2005/0252116 | A1 * | 11/2005 | Maier et al. | 52/223.1 |

FOREIGN PATENT DOCUMENTS

| | | | | |
|---|---|---|---|---|
| EP | 1 331 327 | A1 | 7/2003 | |
| FR | 2590608 | A * | 5/1987 | |
| FR | 2628777 | A1 * | 9/1989 | E04C 5/12 |
| JP | 02266065 | A * | 10/1990 | E04G 21/12 |
| JP | 02272151 | A * | 11/1990 | E04C 5/12 |
| JP | 04285247 | A * | 10/1992 | E04C 3/26 |
| JP | 06158781 | A * | 6/1994 | E04C 5/12 |

(Continued)

*Primary Examiner* — Robert Canfield
*Assistant Examiner* — Charissa Ahmad
(74) *Attorney, Agent, or Firm* — Oliff PLC

(57) ABSTRACT

Disclosed is a force-applying element including a tensioning anchor for anchoring a tape-shaped material to a support structure. The tape-shaped material is pretensioned by means of the tensioning anchor. An extension element is disposed in the transition area between the tensioning anchor and the tape-shaped material following the tensioning process. The extension element is effectively connected to the tape-shaped material and the tensioning anchor.

5 Claims, 9 Drawing Sheets

(56) References Cited

FOREIGN PATENT DOCUMENTS

| | | | |
|---|---|---|---|
| WO | WO 96/21785 | 7/1996 | |
| WO | WO 9832934 A1 * | 7/1998 | ..... E04G 23/02 |
| WO | WO 99/10613 | 3/1999 | |
| WO | WO 01/20097 A1 | 3/2001 | |
| WO | WO 02/103131 A1 | 12/2002 | |
| WO | WO 02/103137 A1 | 12/2002 | |

* cited by examiner

FORCE APPLICATION ELEMENT, EXTENSION ELEMENT, AND A METHOD FOR INCREASING THE TENSILE LOAD OF A STRIP-SHAPED MATERIAL

TECHNICAL FIELD

The invention is based on a force application element, comprising a tensioning anchor to anchor a strip-shaped material to a supporting structure.

The invention also relates to an extension element for a tensioning anchor, a method for increasing the tensile load of a strip-shaped material, as well as the utilization of a force application element to reinforce the supporting structure.

PRIOR ART

For a number of years now, lamellas composed of composite materials, in addition to steel lamellas, have been employed for post-reinforcement of supporting structures. These composite materials are bonded to the supporting structure either slackly without longitudinal pretensioning or pretensioned using terminal anchors. Such terminal anchors are known, and various attachment methods for the transfer of force from a force application element to the composite material have already been put on the market. However, in the case of most currently available force applications the transferable forces are smaller than the tensile strength of the composite material—with the resulting disadvantage that the tensile potential of the composite material is utilized only to a limited extent, thereby providing solutions which are not economical.

In the case of most currently used force applications, the tensile forces occurring during pretensioning are transmitted to the composite material through frictional forces by clamping or adhesive bonding of the tensioning anchor to the composite material. The principal problem with the currently available force applications is the fact that stress peaks are created at the transition from the composite material to the tensioning anchor. The maximal transferable tensile load is reached, however, when the shearing force in the stress peaks reaches the maximum transferable static friction, or the maximum transferable adhesion strength.

In WO 02/103131A1, the attempt was made to divide the tensioning anchor into multiple regions, clamping blocks, which are connected to each other by strain sections of differing flexural rigidity. Before applying the pretension, these clamping blocks are fixedly attached to the strip-shaped tendon, either by adhesive bonding or by clamping. This is intended to prevent shearing stress peaks, which exceed the breaking stress in the adhesion joint or in the friction region at the transition to the anchoring zone.

Experience has shown that even with carefully implemented force applications—described, for example, in the above document, WO 99/10613 A1, and WO 96/21785—the maximum transferable tensile load reaches only about 70% to 75% of the maximum tensile load of the composite material. For this reason, it is possible to load such force applications only up to around 50% of the maximum tensile load of the composite material while maintaining a safety factor of 1.5.

DESCRIPTION OF THE INVENTION

The goal of the invention is therefore to overcome the disadvantages of prior art and provide means which enable the maximum transferable tensile load to be increased.

This goal is achieved by a force application element according to the invention as specified in the claims.

The solution to achieving the goal is based on an approach in which following the tensioning process for the strip-shaped material an extension element is employed in a second step for the purpose of preventing the additional stress buildup at the transition to the tensioning anchor.

In a first step, the strip-shaped material is tensioned through the tensioning anchor to the pretensioning load. In the process, stress peaks are created at the transition from the strip-shaped material to the tensioning anchor. After pretensioning and anchoring on the structure, an extension element is attached, either with an adhesive or mechanically, to the strip-shaped material in the tensioned state. The attachment between the agent and the composite material is at this time tension-free. In response to an additional loading of the material, for example, from operational loads, the resulting additional stresses are transferred primarily through the preceding agent directly into the supporting structure and not, or only to a small degree, into the tensioning anchor. The result is an increase in the total load while the required safety factor is maintained.

The tensioning anchor may also be designated as a clamping head and may essentially be of arbitrary design. For example, this tensioning anchor is composed of two pressure plates and at least one tensioning element, for example a pin, passed through the composite material. Alternatively, the composite material is held supported against a stirrup-shaped yoke by two pressure plates by means of uniformly distributed pressure elements, or by means of a hydraulic pressure chamber acting over the entire pressure surface. Alternatively, in place of pins or plates, clamping wedges are used which are pressed onto the composite material by elliptical annular stirrups.

The advantages of the invention consist in the fact that the solution according to the invention may be employed for any tensioning anchor on the market. This means for reducing stress peaks at the transition to the tension anchor may be an extension element which is mechanically anchored and/or adhesively bonded to the composite material, and so anchored in a tensile-strength-securing manner to the tensioning anchor or transverse cross-member. Alternatively, the transverse cross-member is attached to the composite material in a second procedural step by injection of the adhesive. This tensioning method increases the maximum transferable operational tensile forces by at least 20%-50% into a range of between 300 and 400 kN, while maintaining a safety factor of 1.5.

Additional advantageous embodiments of the invention are described in the subordinate claims.

BRIEF DESCRIPTION OF THE DRAWING

The following discussion explains embodiments of the invention in more detail based on the drawing. In the various figures, identical elements are provided with identical reference numbers.

WAY OF IMPLEMENTING THE INVENTION

Figure 1:
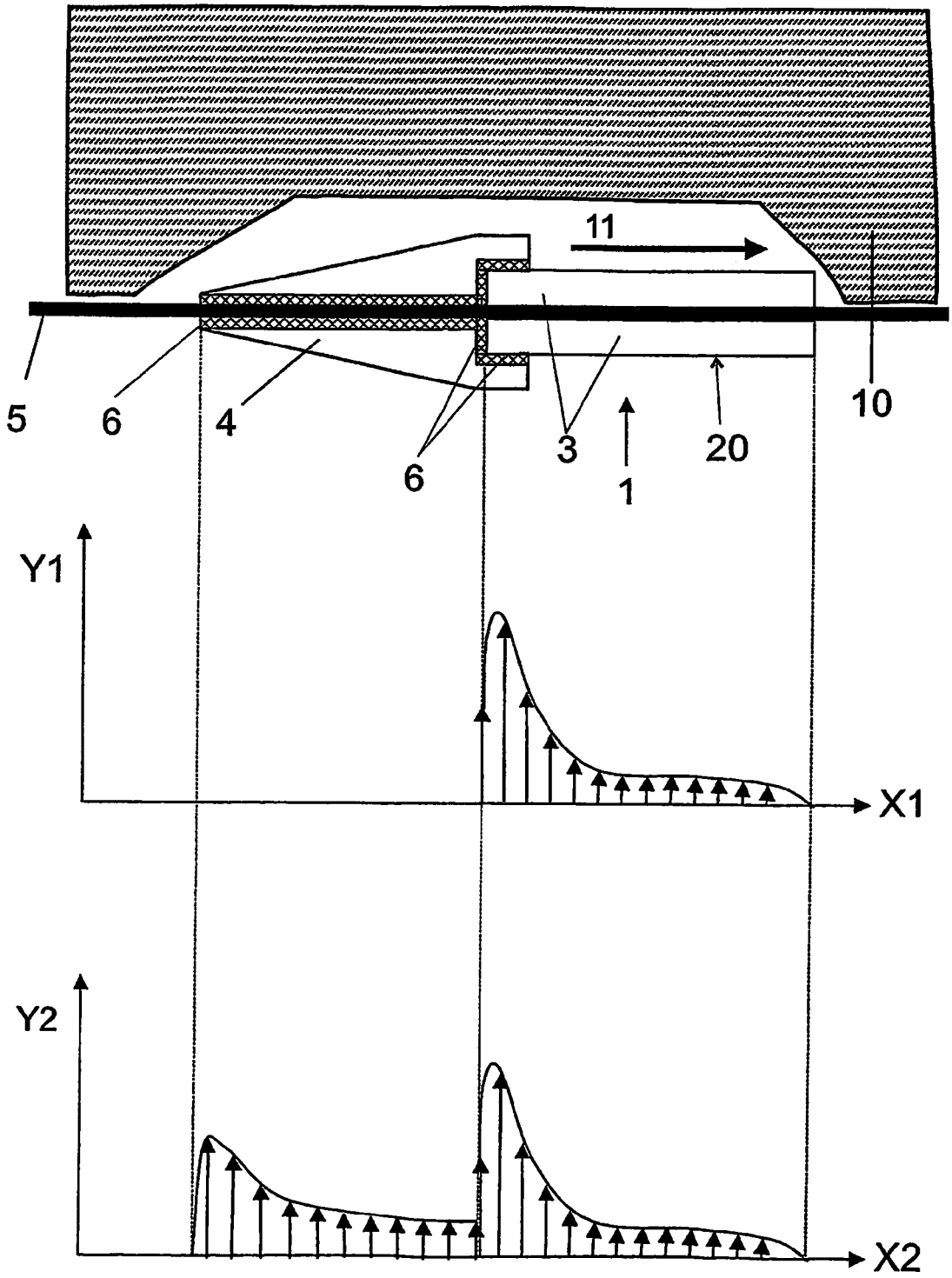
FIG. 1 is a schematic side view of a first embodiment.

FIG. 1 shows a force application element 1, comprising a conventionally known tensioning anchor 20 and an extension element 4 according to the invention after a tensioning process. As known from prior art, tensioning anchor 20 is attached to a strip-shaped material 5, in particular, a composite material, hereafter termed simply a lamella—the attachment being effected by adhesive bonding, clamping, etc. The tensioning process can be first be implemented by a tensioning press in direction of tension 11, the tensioning press being temporarily located on tensioning anchor 20.

Tensioning anchor 20 is retained, for example, within an anchoring tube or shearing pin, not shown, which is affixed in a drilled hole within supporting structure 10.

Following the tensioning process, adhesive 6 is applied in a second step to strip-shaped composite material 5 as well as to the adjacent region of tensioning anchor 20. The adhesive is, in particular, paste-like so as to facilitate application. Extension element 4 is placed on the adhesive paste 6 situated on the strip-shaped composite material, then adhesively bonded to tensioning anchor 20.

Extension element 4 must be attached to tensioning anchor 20 in a tensile-strength-securing manner. The form of extension element 4 is based on the material selected for extension element 4, while the thickness of composite material 5 is selected with the purpose, among other things, of ensuring that extension element 4 tapers down toward composite material 5 and away from the tensioning anchor.

Extension element 4 may be of any form, but will preferably have a tongue-shaped or wedge-shaped design in order to optimally reduce the stress peaks. It is also possible to incorporate into extension element 4 a few centimeters of ribs or folds in direction of tension 11 so as to ensure optimal adhesive bonding and an optimal reduction in tension. The length of extension element 4 on the top and bottom of strip-shaped composite material 5 is preferably 100 mm, in particular, 50 mm. At its center, the extension element preferably has a thickness of 10 mm at maximum, in particular, 5 mm at maximum. Extension element 4 and tensioning anchor 20 are preferably composed of metallic, ductile materials, in particular, aluminum, steel, or titanium.

The adhesive 6, for example, a two-component adhesive based on epoxy resins, must have good adhesion not only to composite material 5 but also to extension element 4, and should exhibit high strength.

The stresses occurring during the tensioning process are graphed in FIG. 1, where X represents the path along force application element 1, and Y represents the force at location X.

The first graph plotting X1 against Y1 shows the stresses acting on force application element 1 after the pretensioning of lamella 5 by tensioning anchor 20 and the completed bonding-on of extension element 4. Since extension element 4 was attached to the lamella and the tensioning anchor only after the tensioning procedure, no stresses occur in this region. The stress peaks are highest at the transition from lamella 5 to tensioning anchor 20, then decrease towards zero at the end of the tensioning anchor.

Second graph plotting X2 against Y2 shows the stresses acting on force application element 1 when the supporting structure is under operational load. The majority of the stresses occurring as a result of the operational load are received by extension element 4 such that stresses occur here as well. As a result, however, the stresses to be received by the tensioning anchor remain essentially the same as in the case of pretensioning as illustrated in the X1 Y1 graph.

As a result of the installation of extension element 4, additional stress peaks at the location of tensioning anchor 20 are largely prevented. As a result, the transferable force increases up to 20%-50% as compared with conventionally known tensioning anchors, while the safety factor of 1.5 is maintained. The available tensile load of composite material 5 can be utilized at a higher level, and an expected tensile force of between 300 kN and 400 kN can be attained.

Composite material 5 may be in the form of a lamella which is composed of fibers and a synthetic resin. The fibers may be configured in one direction, i.e., unidirectionally, or additionally, fibers may be structured in other directions, in particular, at an angle of plus 45° or minus 45° to the unidirectional main fiber direction. The fibers may preferably be composed of aramid, carbon, glass, etc. which are imbedded in the synthetic resin. The synthetic resin may be a duromer, such as, for example, epoxy, acrylate, or a thermoplastic material, such as, for example, polyamide, epoxy, acrylate. In order to achieve optimum adhesion to the pressure plate 3, the surface of composite material 5 is preferably specially marked, for example, roughened by grinding, or pretreated with an adhesive, or treated with a pretreatment system, such as, for example, primer, plasma, etc.

Figure 2:
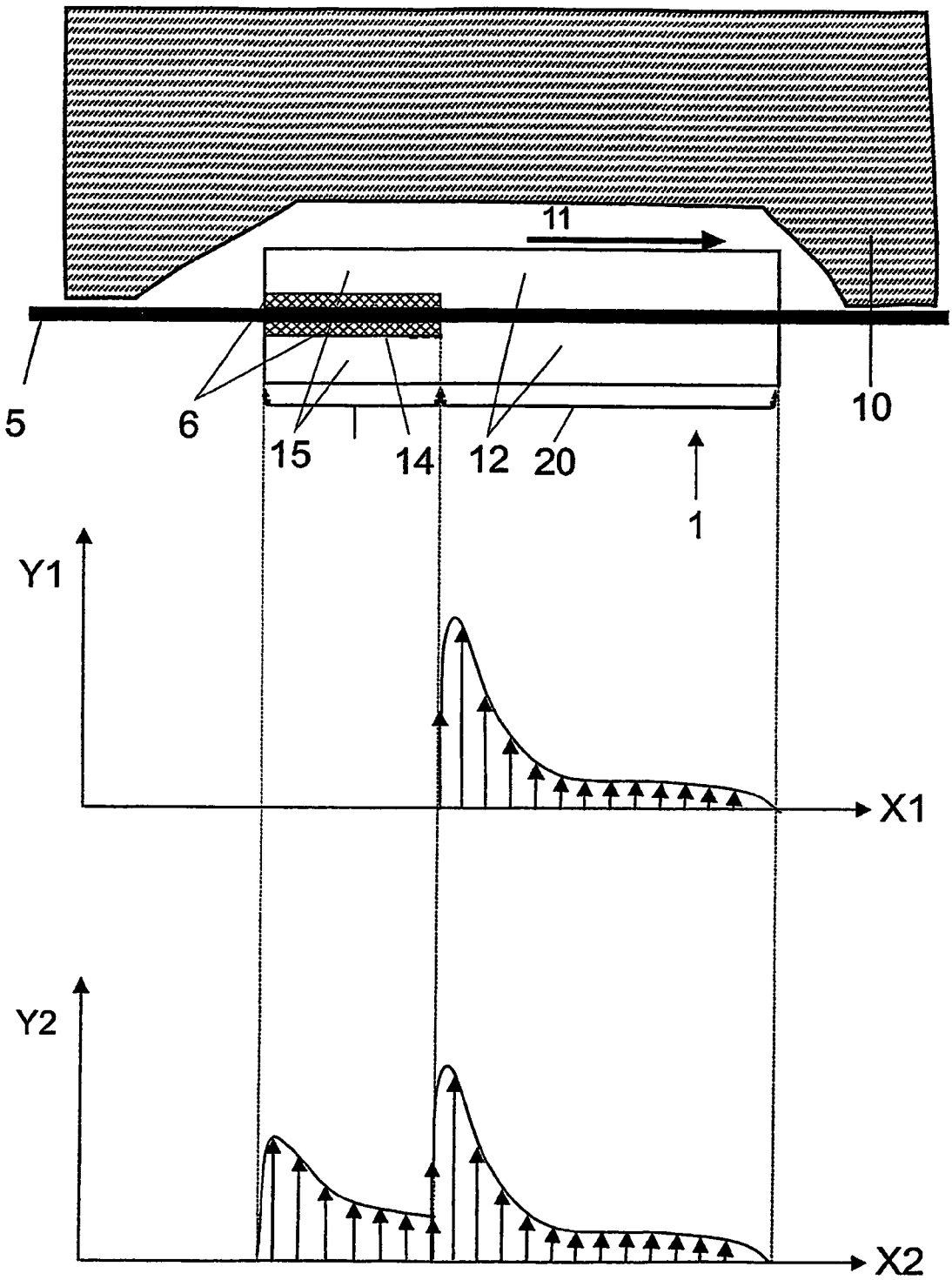
FIG. 2 is a schematic side view of another embodiment.

FIG. 2 illustrates another embodiment of force application element 1. Force application element 1 is composed here of plates 12 which form tensioning anchor 20, and of tongue-shaped projections 15 with recesses 14 which form extension element 4. Plates 12 are attached to lamella 5 using the approach known from the art. Following the tensioning process, adhesive 6 is applied in a second step to the strip-shaped composite material 5 in the region of tongue-shaped projections 15. The adhesive here should have a consistency which enables it to be inserted through the recesses 14 formed by the tongue-shaped projections.

Graphs X1 Y1 and X2 Y2 show that this force application element 1 can assume the same function as that in FIG. 1, whereas here projections 15 form extension element 4.

Figure 3A:
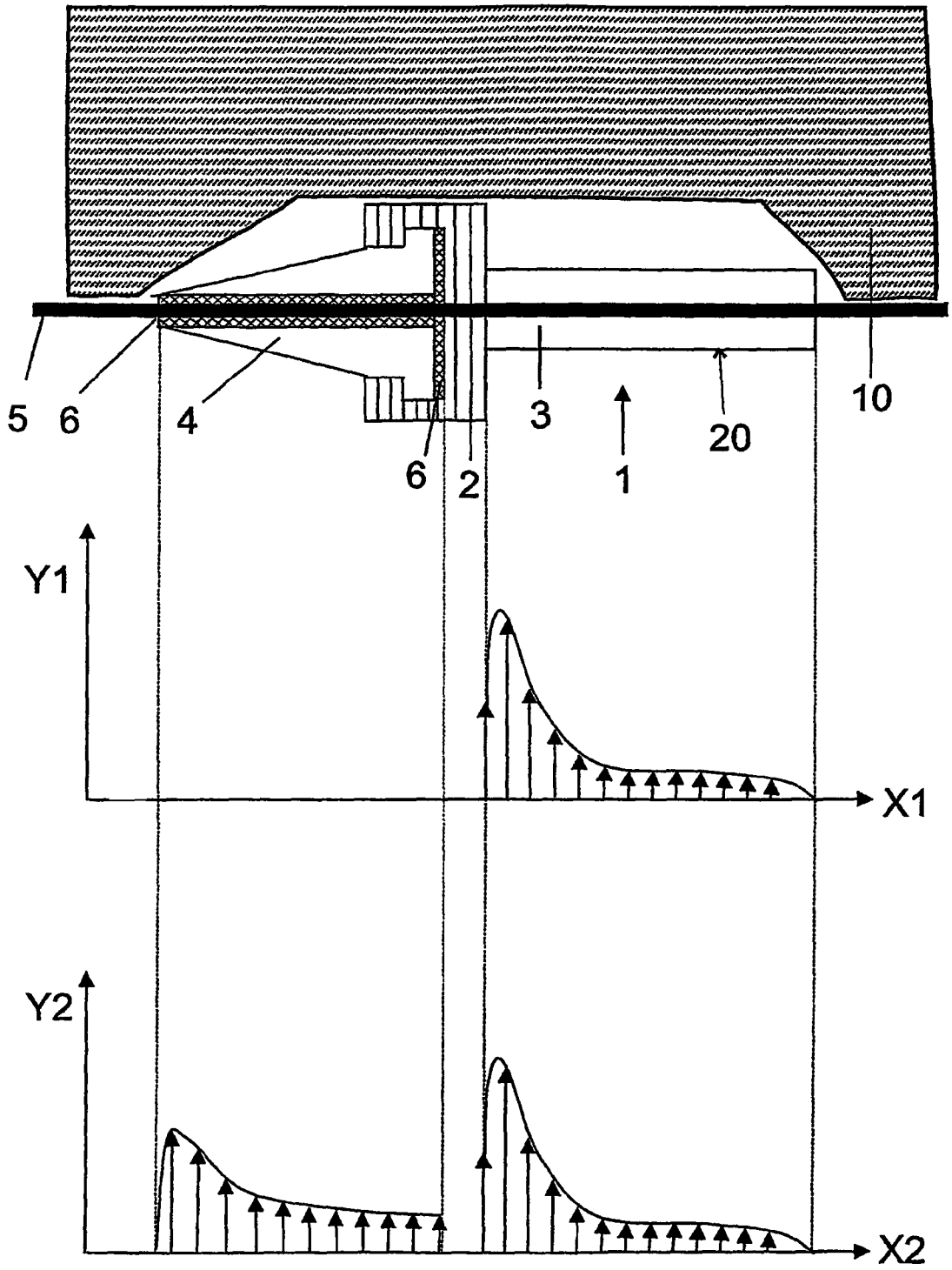
FIG. 3A is a schematic side view of yet another embodiment.
Figure 3B:
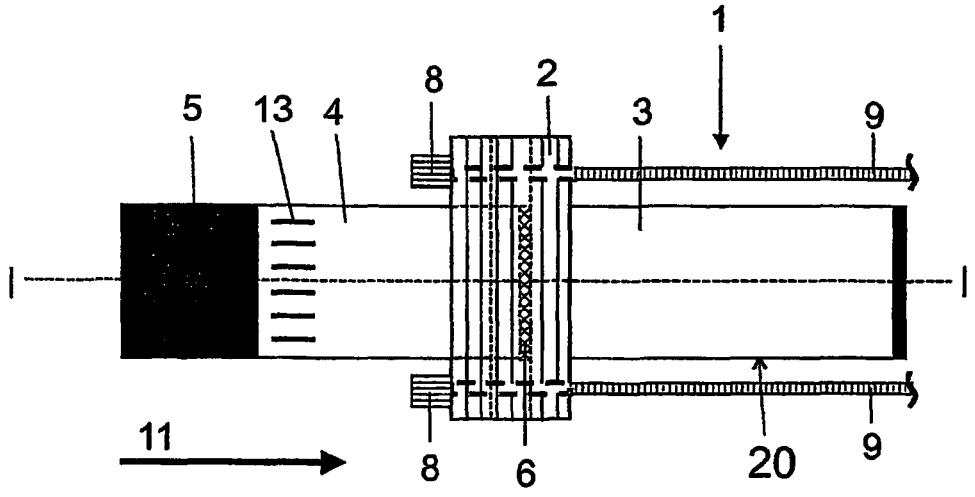
FIG. 3B is a schematic top view of the embodiment of FIG. 3A.

FIGS. 3A and 3B illustrate force application element 1 in another embodiment. The tensioning process here again may be implemented by a tensioning press which is located temporarily on tensioning anchor 20. The tensile load of composite material 5 is subsequently accommodated by a transverse cross-member 2. Threaded rods 9 are installed laterally on tensioning anchor 20, these threaded rods 9 passing through transverse cross-member 2 of tensioning anchor 20. Tensioning anchor 20 is retained by transverse cross-member 2 and threaded rod 9 within an anchoring tube or shearing pin, not shown, which is attached in a drilled hole within supporting structure 10. The tension of composite material 5 can be increased by rotating a threaded screw 8 of threaded rod 9.

Following the process of tensioning force application element 1 in direction of tension 11, adhesive 6 is applied in a second step to composite material 5 on and in front of transverse cross-member 2 opposite tensioning anchor 20. The adhesive is in particular paste-like to facilitate the application. An extension element 4 is placed onto adhesive paste 6 located on strip-shaped composite material 5, adhesively bonded to transverse cross-member 2 of tensioning anchor 20, and preferably mechanically anchored within transverse cross-member 2 by laterally displacing extension element 4. The transverse cross-member has clamp-like projections for this purpose.

As a result, extension element 4 is attached in a tensile-strength-securing manner to transverse cross-member 2. Here too, the form of extension element 4 is based, as in all of the examples, on the material selected for extension element 4 and the thickness of composite material 5, and is selected, among other reasons, such that extension element 4 tapers down toward composite material 5 and away from the transverse cross-member.

Extension element 4 may be of any form, but preferably has a tongue-shaped or wedge-shaped design in order to optimally reduce the stress peaks. It is also possible to incorporate into extension element 4 a few centimeters of ribs or folds in direction of tension 11 so as to ensure optimal adhesive bonding and an optimal reduction in tension.

Graphs X1 Y1 and X2 Y2 show that this force application element 1 can have the same function as in FIG. 1. Since transverse cross-member 2 is not bonded to composite material 5, the stress peaks are highest at the transition from transverse cross-member 2 to tensioning anchor 20, then decrease towards zero by the end of pressure plates 3 of tensioning anchor 20 opposite transverse cross-member 2. As a result of the installation of extension element 4, additional stress peaks are largely prevented at the location of transverse cross-member 2 and force application element 1.

Figure 3C:
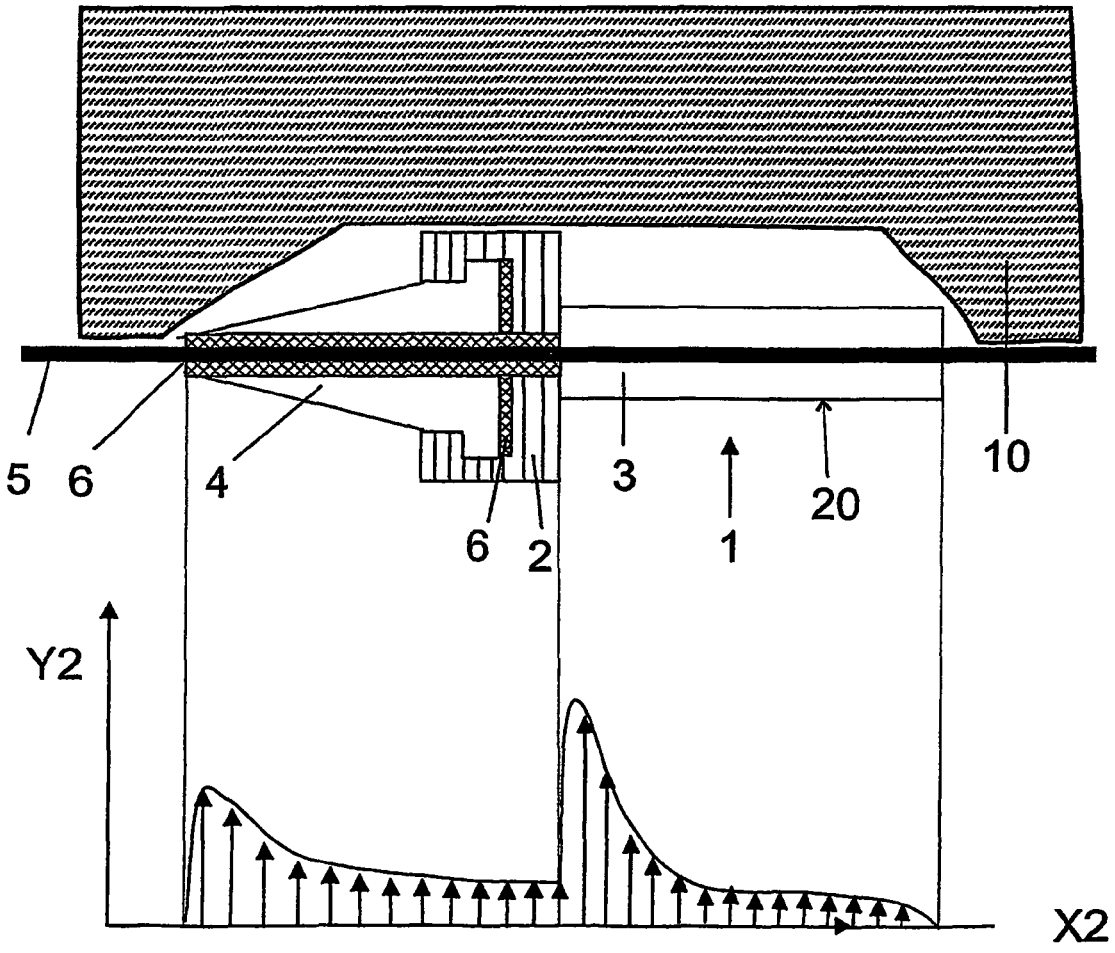
FIG. 3C is a schematic side view of another embodiment based on FIG. 3A employing a slight modification.

FIG. 3C shows force application element 1 in which, following the tensioning process, adhesive bonding has been implemented between transverse cross-member 2 and composite material 5, and extension element 4 has been installed. The result is a stress curve 12 which differs from that shown in FIG. 3A in the region of transverse cross-member 2, with the result that the transverse cross-member is also able to accommodate stresses produced by the operational load.

Figure 4A:
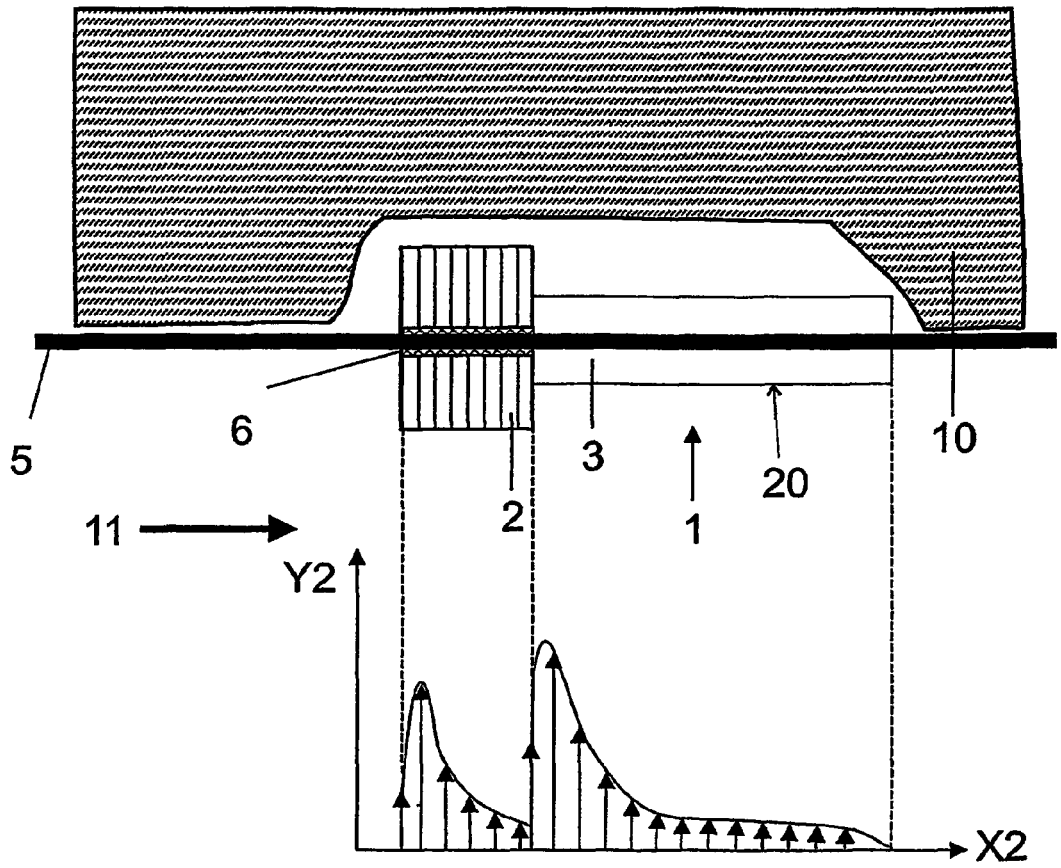
FIG. 4A is a side view of another embodiment.
Figure 4B:
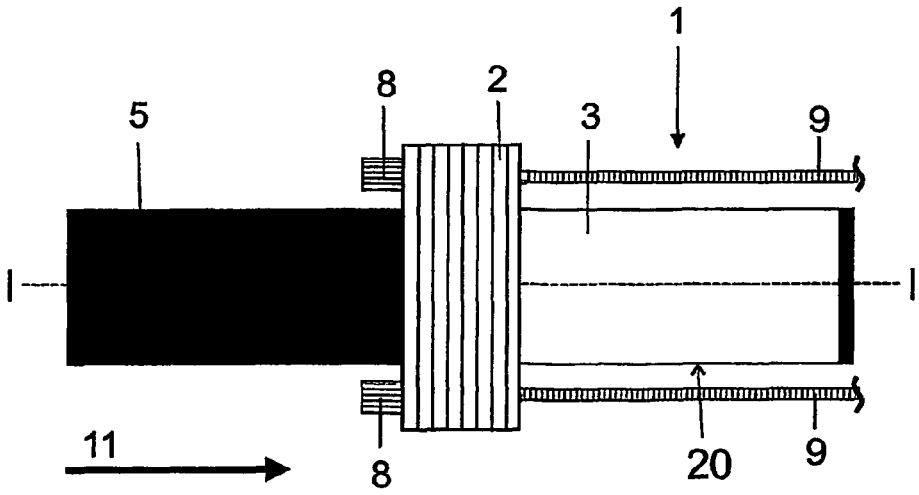
FIG. 4B is a top view of the embodiment of FIG. 4A.

FIGS. 4A and 4B show that following the process of tensioning a force application element 1 in direction of tension 11, transverse cross-member 2 is attached in a second step to composite material 5 by injection of adhesive 6, transverse cross-member 2 thus taking over the function of extension element 4. Since transverse cross-member 2 is bonded to composite material 5 in a second step, the stress peaks under an operational load are at their highest level both at the location of transverse cross-member 2 and composite material 5, as well at the location of transverse cross-member 2 and force application element 1, and diminish in direction of tension 11.

Figure 5A:
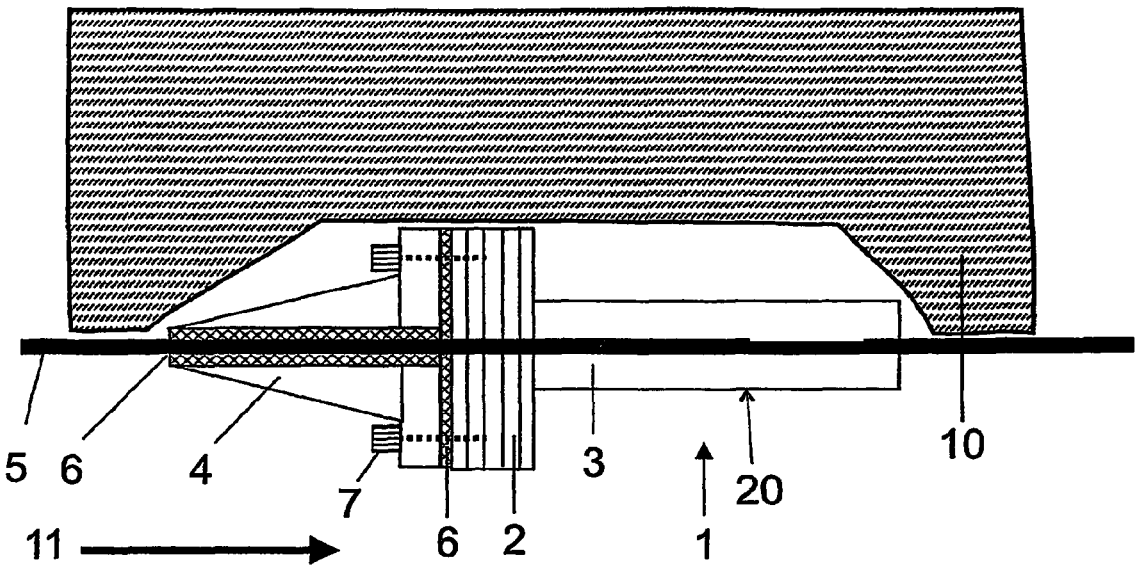
FIG. 5A is a side view of another embodiment.
Figure 5B:
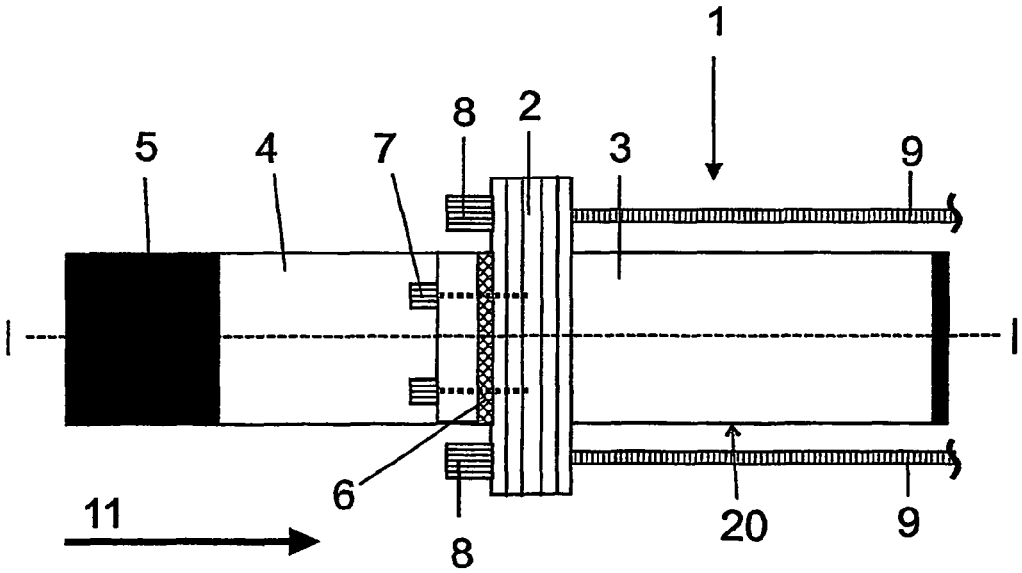
FIG. 5B is a top view of the embodiment of FIG. 5A.

In FIGS. 5A and 5B, extension element 4 is placed on adhesive paste 6 on strip-shaped composite material 5 and bonded to transverse cross-member 2 of force application element 1, then fixed with at least one screw 7. For this purpose, extension element 4 has a projection with holes through which the screws can be inserted and connected to the transverse cross-member.

Figure 6A:
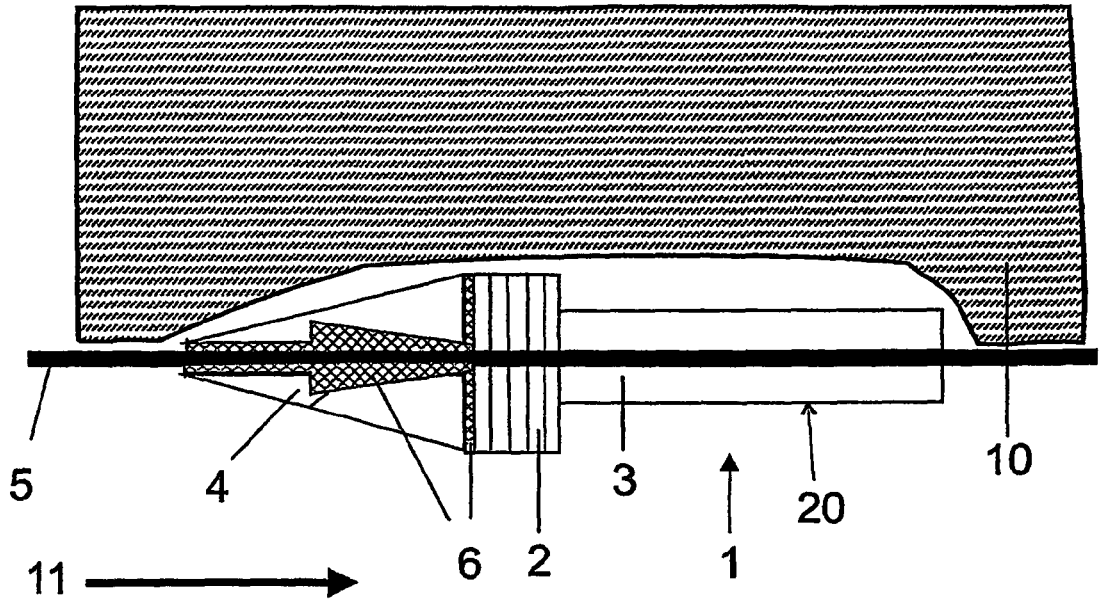
FIG. 6A is a side view of another embodiment having a wedge-shaped bonding of the extension element to the composite material.
Figure 6B:
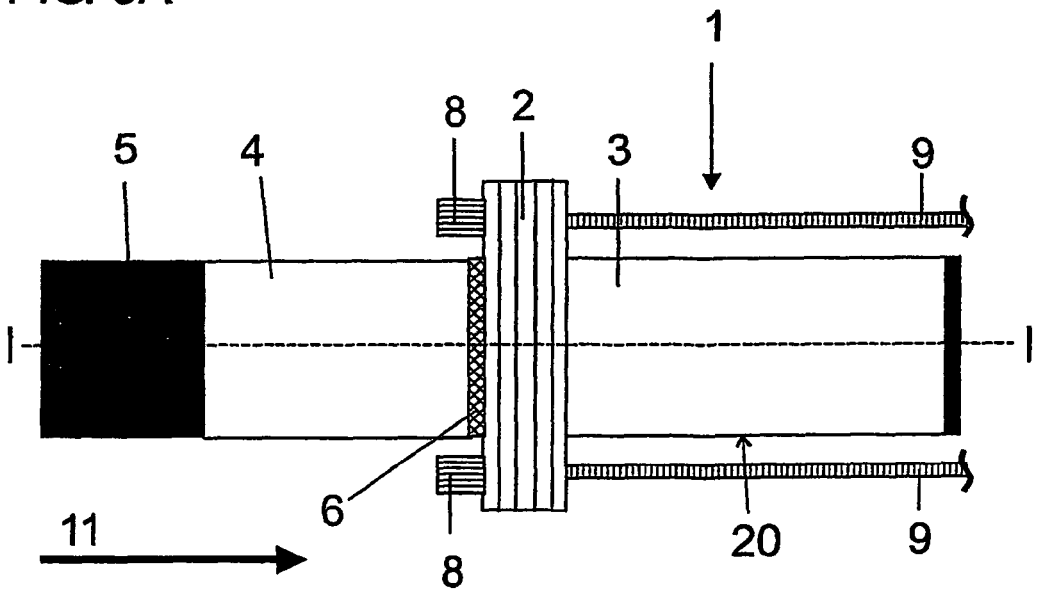
FIG. 6B is a top view of the embodiment of FIG. 6A.
Figure 6C:
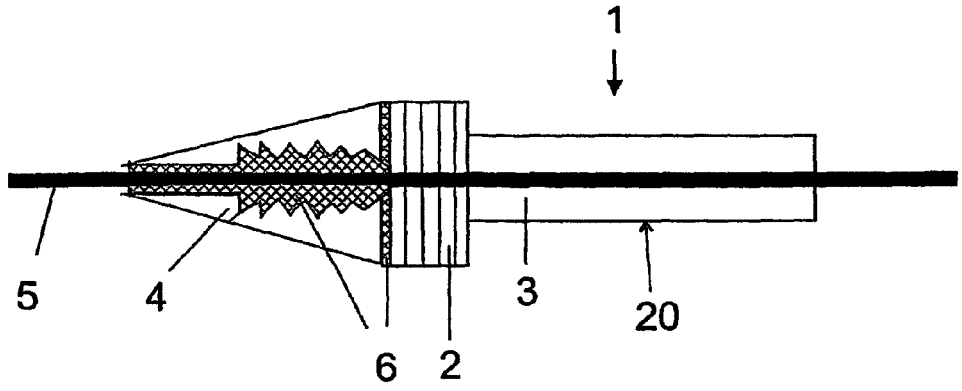
FIG. 6C is a side view of another embodiment having a zigzag-shaped bonding of the extension element to the composite material.

In the embodiments shown in FIGS. 6A, 6B, 6C, the bottom of extension element 4 has a special form so as to ensure a proper adhesive bond, and thus a high stress load in direction of tension 11. Here against, extension element 4 is placed on adhesive 6 which has been applied on strip-shaped composite material 5, then similarly adhesively bonded to transverse cross-member 2 of force application element 1.

Figure 6D:
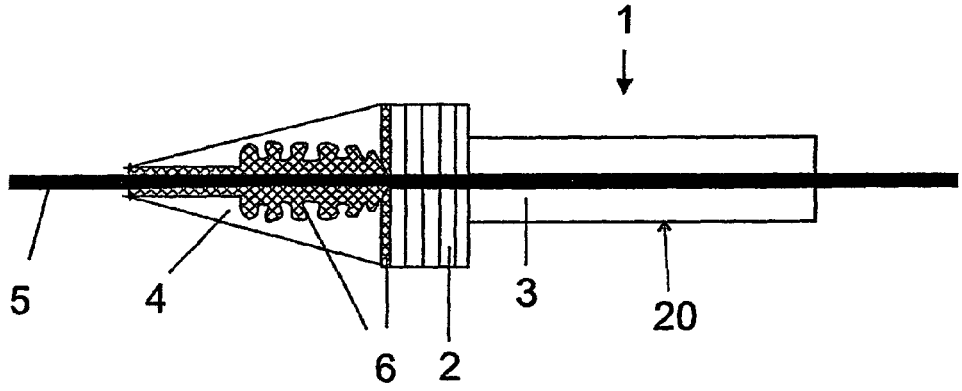
FIG. 6D is a side view of another embodiment having a wave-shaped bonding of the extension element to the composite material.

The bottom of extension element 4 facing composite material 5 is, for example, wedge-shaped as in FIG. 6A, zigzag-shaped as in FIG. 6C, or wave-shaped as in FIG. 6D. It may be necessary to dispense with the special form in the region of the taper due to the small thickness of the extension element. These above-described forms may also be applied to transverse cross-member 2.

Figure 7:
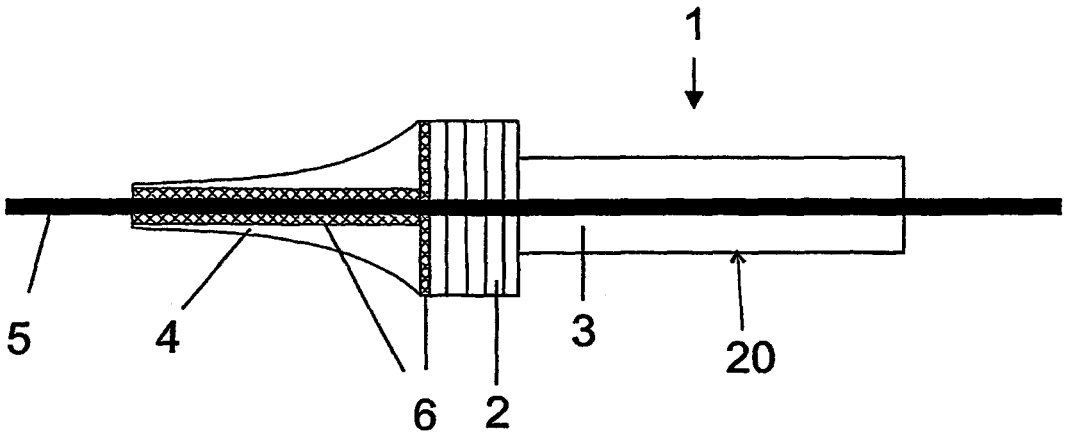
FIG. 7 is a side view of an especially preferred embodiment of an extension element having a hyperbolic design.

FIG. 7 illustrates an especially preferred embodiment of the extension element. As was described above, extension element 4 may have any form; what is preferred, however, are such designs as tongue-shaped, wedge-shaped or hyperbolic ones which optimally reduce the stress peaks. Experience has shown in particular that extension elements which have a wedge-shaped or hyperbolic taper implement this function optimally. The hyperbolic taper here should be designed such that the extension element at half the distance/length of the extension element has a maximum thickness of 10 mm, preferably, less than 5 mm. The hyperbolic form may, of course, also be implemented differently and must in each case be adapted to the stress conditions expected.

It is of course understood that the invention is not limited to the embodiments shown and described. For example, the specific design of extension element 4 is arbitrary per se, and combinations or other embodiments of the embodiments shown in FIG. 6 are also possible.

In addition to the shown strip-shaped composite materials, it is of course also possible that other strip-shaped materials and lamellas used to reinforce the supporting structure be provided together with the extension element, thereby increasing the load-bearing capacity.

Extension element 4 may, of course, already be attached to tensioning anchor 20, or be attached to tensioning anchor 20 and/or the strip-shaped material by adhesive bonding or mechanical means.

LIST OF REFERENCE NOTATIONS

1 force application element
2 transverse cross-member
3 pressure plate
4 extension element
5 strip-shaped material, in particular, composite material
6 adhesive
7 screws
8 threaded screw
9 threaded rod
10 supporting structure
11 direction of tension
12 pressure plate
13 ribs
14 recess
15 projection
20 tensioning anchor

The invention claimed is:

1. A method to increase a tensile load of a strip-shaped material, the method comprising:

pretensioning the strip-shaped material using a tensioning anchor; and following the tensioning process, attaching an extension element to the strip-shaped material and the tensioning anchor in a transition region between the tensioning anchor and the strip-shaped material, said extension element serving to prevent additional stress peaks in the event of stresses to the material above the pretension load, wherein the extension element is directly attached to at least one of the tensioning anchor or a transverse cross-member of the tensioning anchor by at least one of mechanical attachment or adhesive attachment.

2. The method according to claim 1, further comprising attaching the extension element to the strip-shaped material by at least one of mechanical attachment or adhesive attachment.

3. The method according to claim 1, wherein the extension element is composed of a ductile material.

4. The method according to claim 1, wherein a side of the extension element opposite the strip-shaped material has an enlarged and structured surface.

5. A method to increase a tensile load of a strip-shaped material, the method comprising:

pretensioning the strip-shaped material using a tensioning anchor; and following the tensioning process, attaching an extension element to the strip-shaped material and the tensioning anchor in a transition region between the tensioning anchor and the strip-shaped material, said extension element serving to prevent additional stress peaks in the event of stresses to the material above the pretension load, wherein the extension element has at least one of a hyperbolic, tongue-shaped or wedge-shaped form and tapers down toward the strip-shaped material in a direction of the center of the strip-shaped material.

* * * * *